US006470848B2

(12) United States Patent
Takahashi et al.

(10) Patent No.: US 6,470,848 B2
(45) Date of Patent: Oct. 29, 2002

(54) FUEL TANK-MOUNTING STRUCTURE FOR PORTABLE POWER WORKING MACHINE

(75) Inventors: Kazunori Takahashi, Saitama (JP); Tadashi Kamoshita, Saitama (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/863,501

(22) Filed: May 23, 2001

(65) Prior Publication Data

US 2001/0047993 A1 Dec. 6, 2001

(30) Foreign Application Priority Data

May 24, 2000 (JP) ..... 2000-153756

(51) Int. Cl.[7] ..... F02B 77/00
(52) U.S. Cl. ..... 123/198 E
(58) Field of Search ..... 123/198 E, 195 C, 123/195 A, 184.46

(56) References Cited

U.S. PATENT DOCUMENTS 4,223,899 A * 9/1980 Krieger ..... 280/5
5,195,780 A * 3/1993 Inoue et al. ..... 280/834
5,233,945 A * 8/1993 Wolf et al. ..... 123/41.7
5,794,559 A * 8/1998 Graham ..... 114/343
6,100,599 A * 8/2000 Kouchi et al. ..... 290/1 A

* cited by examiner

*Primary Examiner*—Gene Mancene
*Assistant Examiner*—Hyder Ali
(74) *Attorney, Agent, or Firm*—Baker Botts LLP

(57) ABSTRACT

A fuel tank-mounting structure for a portable power working machine, which has an internal combustion engine as a power source and a fuel tank received in a tank housing portion defined in a two-piece cover housing of the power working machine, includes cushioning members supporting the fuel tank in the tank housing portion of the two-piece cover housing. The cushioning members are interposed in spaces between the tank housing portion and all faces of the fuel tank, namely, the front and rear end faces, the right and left side faces, and the top and bottom faces of the fuel tank. The cushioning members prevent the vibration of the internal combustion engine from being easily transmitted to the fuel tank, thereby avoiding the generation of bubbles in the fuel as well as damage to the fuel tank, and also reduce the manufacturing cost of the fuel tank-mounting structure.

4 Claims, 6 Drawing Sheets

FUEL TANK-MOUNTING STRUCTURE FOR PORTABLE POWER WORKING MACHINE

BACKGROUND OF THE INVENTION

The present invention relates to a fuel tank-mounting structure for a portable power working machine, such as a leaf blower, a sprayer, and the like, wherein a fuel tank is received in a tank housing portion defined by a two-piece cover housing of the power working machine.

FIG. 6 is an exploded perspective view of a previously known leaf blower, representing one example of a portable power working machine provided with the aforementioned fuel tank-mounting structure. In the assembled state, the leaf blower of FIG. 6 is similar in external appearance to the leaf blower shown in FIG. 1, which shows one embodiment of the present invention as described hereinafter.

The conventional leaf blower 5 shown in FIG. 6 is provided with right and left cover housings 12 and 11 constituting a two-piece structure, in which a centrifugal air blower 20 and an internal combustion engine (a small air-cooled two-stroke gasoline engine) 30 for rotatably driving the air blower 20 are housed and held in place. External air is inducted from an intake port (not shown) provided on the left side of the left cover housing 11 and accelerated in a volute case 22 provided integrally with the left cover housing 11. The accelerated air is discharged from an exhaust nozzle 25 defining the terminal portion (an upper front portion) of the volute case 22 and then ejected out of the leaf blower 5 through a flexible tube or an ejection tube (not shown), to thereby blow fallen leaves and refuse.

On the top of the left cover housing 11, there is mounted a handle 15 which is provided with a throttle lever 17 for controlling the carburetor throttle valve (not shown) of the internal combustion engine 30 and also with an engine stop switch 18.

Tank housing portions 42 and 41 (40) for housing and retaining a fuel tank 50' for the fuel (gasoline) for the internal combustion engine 30 are provided at a lower portion of each of the right and left cover housings 12 and 11.

The fuel tank 50' is a closed container shaped into an elongated (in the longitudinal direction of the cleaner 5) rectangular parallelopiped and provided at an upper rear portion thereof (proximal side in the drawing) with a fuel-filling port 55 which extends upward and slopes rightward. The fuel tank 50' is also provided on the left side of the fuel-filling port 55 thereof with a grommet-attached insertion hole 56 through which a fuel intake pipe, a return pipe and a tank inner pressure-adjusting pipe (not shown) are introduced into the fuel tank 50'. A bottom V-groove 52 is formed on the underside of the fuel tank 50', the bottom V-groove 52 being adapted to be engaged with a ridge-like protrusion 44 that projects upwardly from the bottom face of the left tank housing portion 41. A sloping recess portion 54 is formed on the upper surface of the fuel tank 50', the recess portion 54 being adapted to be engaged with a protrusion (not visible) at the upper left side portion of the fuel tank housing 40.

The fuel tank 50' is provided with anchoring lugs 58 that protrude from a central portion of the front and rear end faces of the fuel tank 50', respectively, the anchoring lugs 58 being designed to be fixed, by means of a screw 59, to columnar mounting portions 60 attached to and protruding from the inner wall of the left tank housing portion 41, thereby fastening the fuel tank 50' to the left tank housing portion 41.

A tapped hole 47 is formed at each of the ridge-like protrusion 44 and the front and rear upper edge portions of the left tank housing portion 41. In conformity with these tapped holes 47 formed in the left tank housing portion 41, the right tank housing portion 42 is also provided at each of three portions thereof with a screw-receiving hole (e.g., 49). Therefore, the right and left tank housing portions 42 and 41 can be joined face to face with each other by introducing screws (e.g., 59) from the right cover housing 12 side through the screw-receiving holes 49 and by threading the screws 59 into the tapped holes 47, thereby clamping the right and left cover housings 12 and 11 to each other.

The right cover housing 12 is provided with cut-out portions 37 and 36 for enabling the muffler 32 of the internal combustion engine 30 and a recoil starter 34 (i.e., the handle 34*a* thereof) to extend out of the right cover housing 12, and also with a semi-cylindrical port 39 for facilitating removing and attaching the cap of the fuel-filling port 55 of the fuel tank 50'.

In the conventional fuel tank-mounting structure for a portable power working machine of FIG. 6, the fuel tank is fastened to the tank housing portion by anchoring lugs provided on the fuel tank by making use of the screws, as described above. The conventional fuel tank-mounting structure, however, has the following problems.

(1) The vibration of the internal combustion engine and/or of the air blower is directly transmitted to the fuel tank, and due to the vibration, bubbles are generated in the fuel in the fuel tank. Bubbles in the fuel supplied to the internal combustion engine can cause the performance of the internal combustion engine to deteriorate;

(2) Since not only the fuel tank but also the tank housing portion are both required to be provided with mounting members (such as the aforementioned anchoring lugs) for fastening the fuel tank, the manufacturing cost of the power machine is increased, and at the same time, the configuration of the fuel tank is restricted by such mounting members; and (3) Stresses due to the vibrations of the tank are concentrated at the connections of the aforementioned anchoring lugs with the tank body; the concentrated stresses can lead to fracture of the anchoring lugs.

SUMMARY OF THE INVENTION

The present invention has been made to overcome the aforementioned problems, and therefore an object of the present invention is to provide a fuel tank-mounting structure for a portable power working machine, which is capable of preventing the vibration of the internal combustion engine from being easily transmitted to the fuel tank, thereby avoiding possible deterioration in performance of the internal combustion engine due to formation of bubbles in the fuel, preventing possible damage to the fuel tank, and reducing the manufacturing costs of the fuel tank-mounting structure.

With a view to attaining the aforementioned objects, there is provided, according to the present invention, a fuel tank-mounting structure for a portable power working machine having an internal combustion engine as a power source and a fuel tank that is received in a tank housing portion of a two-piece cover housing of the power working machine. According to the invention, the fuel tank is retained in the tank housing portion by being embraced by one or more cushioning members.

In a preferred embodiment of the present invention, the cushioning member(s) is interposed in spaces between the tank housing portion and all faces of the fuel tank, namely, the front and rear end faces, the right and left side faces, and the top and bottom faces of the fuel tank. Advantageously, the cushioning member(s) is immovably sandwiched between the cover housing and the fuel tank.

The fuel tank-mounting structure, according to the present invention, may include a front end portion-sustaining cushioning member of a generally U-shape in cross section and having an inner surface that engages at least three faces of the fuel tank selected from the front end face, the right side face, the left side face, the top face and the bottom face of the fuel tank and a rear end portion-sustaining cushioning member of a generally U-shape in cross section and having an inner surface that engages at least three faces of the fuel tank selected from the rear end face, the right side face, the left side face, the top face and the bottom face of the fuel tank.

In especially preferred embodiments, there are a front end portion-sustaining cushioning member having a generally U-shaped cross section, the inner surface of which contacts four faces of the fuel tank including the front end face, the top face, the bottom face and one of the right side face and the left side face of the fuel tank, a rear end portion-sustaining cushioning member having a generally U-shaped cross section, the inner surface of which contacts four faces of the fuel tank including the rear end face, the top face, the bottom face and said one of the right side face and the left side face of the fuel tank, and a side face-sustaining cushioning member which contacts the other of the right side face and the left side face. With a fuel tank-mounting structure of the present invention, as described immediately above, the fuel tank is retained in the tank housing portion by being embraced not only by a pair of end portion-sustaining cushioning members, each having a generally U-shaped cross section, the inner surface of each of which engages four faces constituting the front or rear end portions of the fuel tank but excluding one of the right and left side end faces, but also by a side face-sustaining cushioning member, which engages the other of the right and left side faces. In other words, the cushioning members are respectively interposed in spaces between the tank housing portion and all faces of the fuel tank, i.e., the front and rear end faces, the right and left side faces, and the top and bottom faces of the fuel tank, and at the same time, the cushioning members are immovably sandwiched between the cover housings and the fuel tank. Therefore, the fuel tank is sustained in the tank housing portion in such a manner that the fuel tank is "floated" away from the inner surfaces (all inner surfaces) of the tank housing portion by the cushioning members.

The fuel tank-mounting structure according to the present invention reduces the transmission of vibrations of the internal combustion engine or of the air blower to the fuel tank, thereby making it possible to inhibit the generation of bubbles in the fuel and preventing deterioration in performance of the engine. Furthermore, since the mounting members (such as the aforementioned anchoring lugs) and screws for fastening the fuel tank are no longer required to be employed, the configuration of the fuel tank can be selected relatively freely, and at the same time, the manufacturing cost of the power machine can be reduced. Additionally, since the fuel tank is embraced by cushioning members, damage to the fuel tank is hardly possible.

The cushioning members should preferably be manufactured somewhat larger in size than the fuel tank housing portions of the cover housings so as to permit the cushioning members to be slightly compressed between the fuel tank and the cover housings as the cushioning members are installed together with the fuel tank in the tank housing portion. Further, if the fuel tank is made of a synthetic resin having a suitable degree of an oil-swelling property, such as polyethylene, the fuel tank swells with time, thereby making it possible to maintain the tightness in retention of the fuel tank even if the cushioning members lose some of their initial compression as originally installed. Therefore, even if fuel is spilled on the occasion of filling the tank with fuel, the spilled fuel can be prevented from entering into the interface between the fuel tank and cushioning members, and can be simply allowed to fall and discharge through an opening formed at the bottom of the tank housing portion.

Further, if engine cooling air is inducted from the opening formed at the bottom of the tank housing portion and flows along portions of the side walls of the fuel tank, the fuel tank can be cooled by the cooling air, thereby making it possible to maintain the temperature of the fuel at a suitably low degree.

For a better understanding of the present invention and the advantages thereof, an embodiment of the fuel tank-mounting structure according to the present invention is described below with reference to the accompanying drawings.

DETAILED DESCRIPTION OF THE INVENTION

Figure 1:
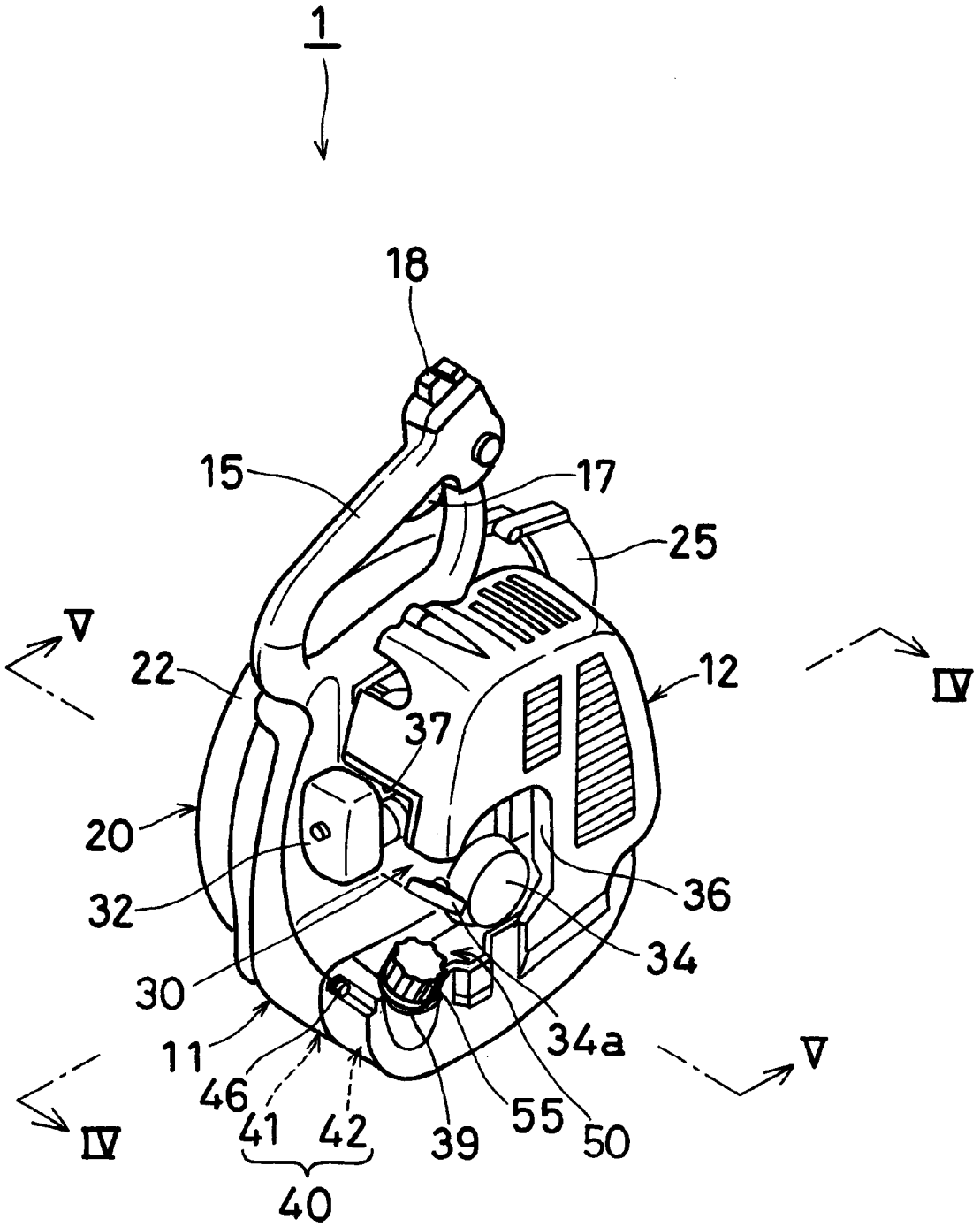
FIG. 1 is a perspective view illustrating a leaf blower representing one example of a portable power working machine provided with a fuel tank-mounting structure according to the present invention.
Figure 2:
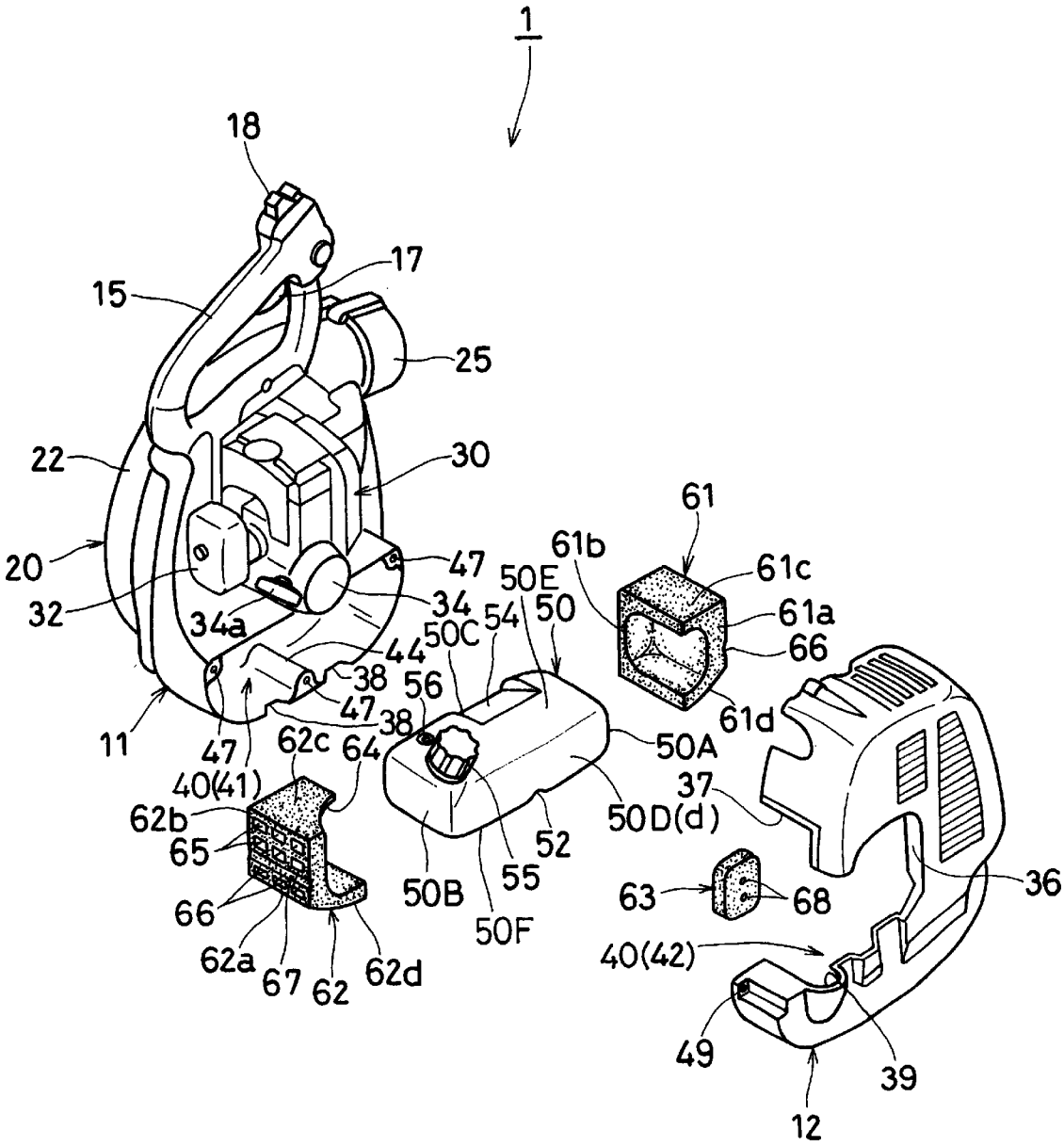
FIG. 2 is an exploded perspective view of the leaf blower shown in FIG. 1.
Figure 6:
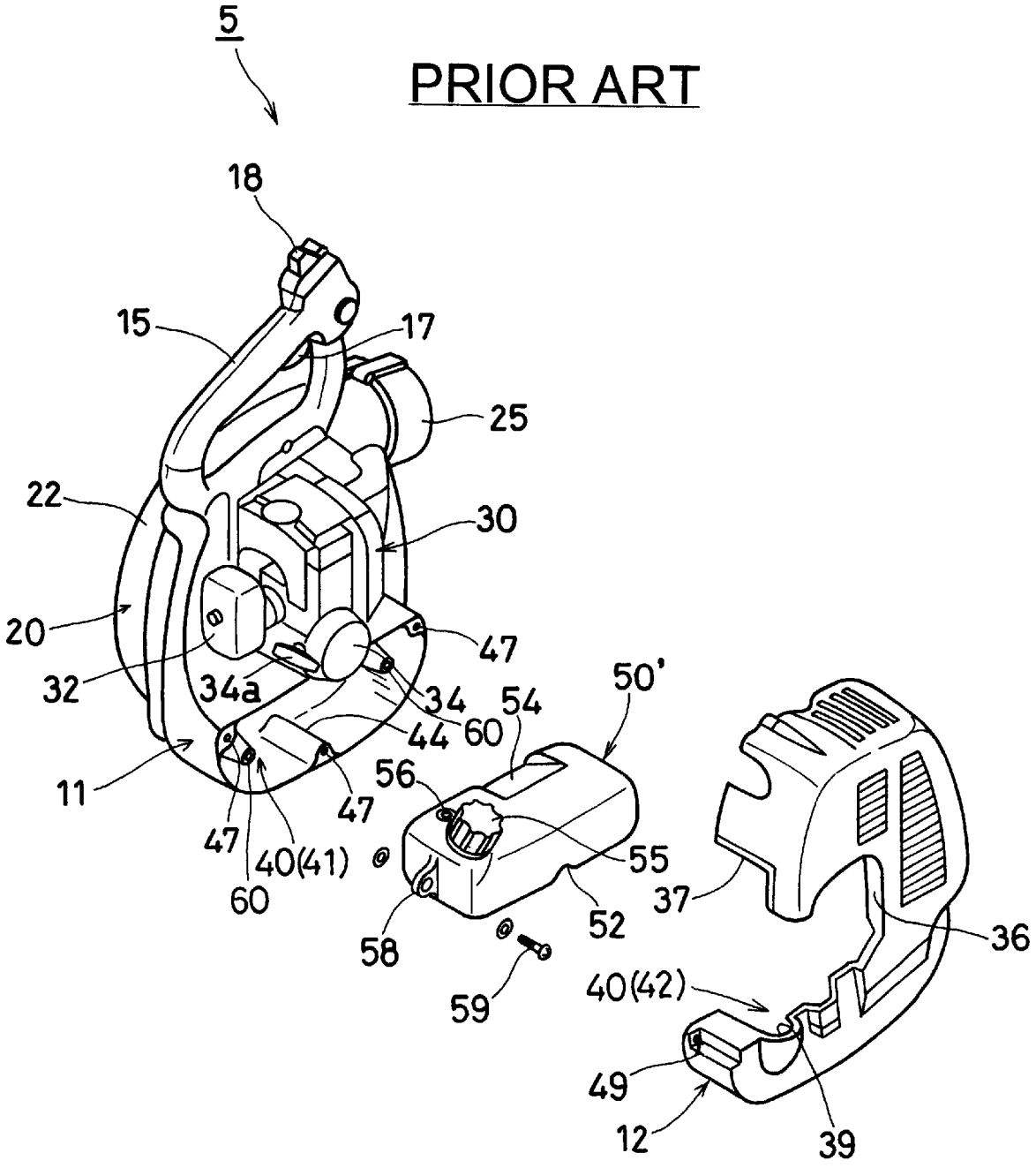
FIG. 6 PRIOR ART
FIG. 6 is an exploded perspective view illustrating a leaf blower representing one example of a portable power working machine provided with a fuel tank-mounting structure according to the prior art.

Referring to FIGS. 1 and 2, the same components as those of the conventional leaf blower 5 shown in FIG. 6 are identified by the same reference numbers as indicated in FIG. 6. A leaf blower 1 according to the embodiment has right and left cover housings 12 and 11 constituting a two-piece structure, in which a centrifugal air blower 20 and an internal combustion engine (a small air-cooled two-stroke gasoline engine) 30 for rotatably driving the centrifugal air blower 20 are housed and held in place. In this case, the external air is inducted from an intake port (not shown) provided on the left side of the left cover housing 11 and accelerated in a volute case 22 that is unitary with the left cover housing 11. The accelerated air is discharged from an exhaust nozzle 25 defining the terminal portion (an upper front portion) of the volute case 22 and then ejected out of the cleaner 5 through a flexible tube or an ejection tube (not shown), to thereby blow fallen leaves and refuse.

On the top of the left cover housing 11, there is mounted a handle 15 which is provided with a throttle lever 17 for controlling the carburetor throttle valve (not shown) of the internal combustion engine 30 and also with an engine stop switch 18.

Further, tank housing portions 42 and 41 (40) for housing and retaining a fuel tank 50 for storing fuel (gasoline) for the internal combustion engine 30 are provided at a lower portion of each of the right and left cover housings 12 and 11. In this case, the fuel tank 50 is formed of polyethylene having a suitable degree of oil-swelling property.

The fuel tank 50 is formed of a closed container shaped into an elongated (in the longitudinal direction of the leaf blower 1) rectangular parallelopiped and provided at an upper rear portion 50B thereof (proximal side in the drawing) with a fuel-filling port 55, which protrudes upwardly and is inclined rightwardly. The fuel tank 50 is also provided on the left side of the fuel-filling port 55 thereof with a grommet-attached insertion hole 56 through which a fuel intake pipe, a return pipe and a tank inner pressure-adjusting pipe (not shown) are permitted to be introduced into the fuel tank 50. Furthermore, a bottom V-groove 52 is formed on the underside of the fuel tank 50, the bottom V-groove 52 being adapted to be engaged with a ridge-like protrusion 44 which projects up from the bottom face of the left tank housing portion 41. A sloping recess 54 on the upper surface of the fuel tank 50 accepts a complementary protruding surface of the upper left side portion of the fuel tank housing portion 40.

A tapped hole 47 is formed at each of the ridge-like protrusion 44 and the front and rear upper edge portions of the left tank housing portion 41. In conformity with these tapped holes 47 formed in the left tank housing portion 41, the right tank housing portion 42 is also provided at each of three portions thereof with a screw-receiving hole 49. Therefore, the right and left tank housing portions 42 and 41 can be connected face to face with each other by introducing screws 46 from the right cover housing 12 side into the screw-receiving holes 49 and by threading the screws 46 into the tapped holes 47, thereby clamping the right and left cover housings 12 and 11 to each other (see also FIGS. 4 and 5).

The right cover housing 12 is provided with cut-out portions 37 and 36 that permit the muffler 32 of the internal combustion engine 30 and a recoil starter 34 (i.e., the handle 34*a* thereof) to extend out of the right cover housing 12, and with a semi-cylindrical recess 39 for facilitating removing and installing the cap of the fuel-filling port 55 of the fuel tank 50.

For the purpose of mounting the fuel tank 50 in the tank housing portion 40, there are provided, according to the embodiment, a front-end sustaining cushioning member 61, a rear-end sustaining cushioning member 62, and a sidewall-contacting cushioning member 63.

Figure 3:
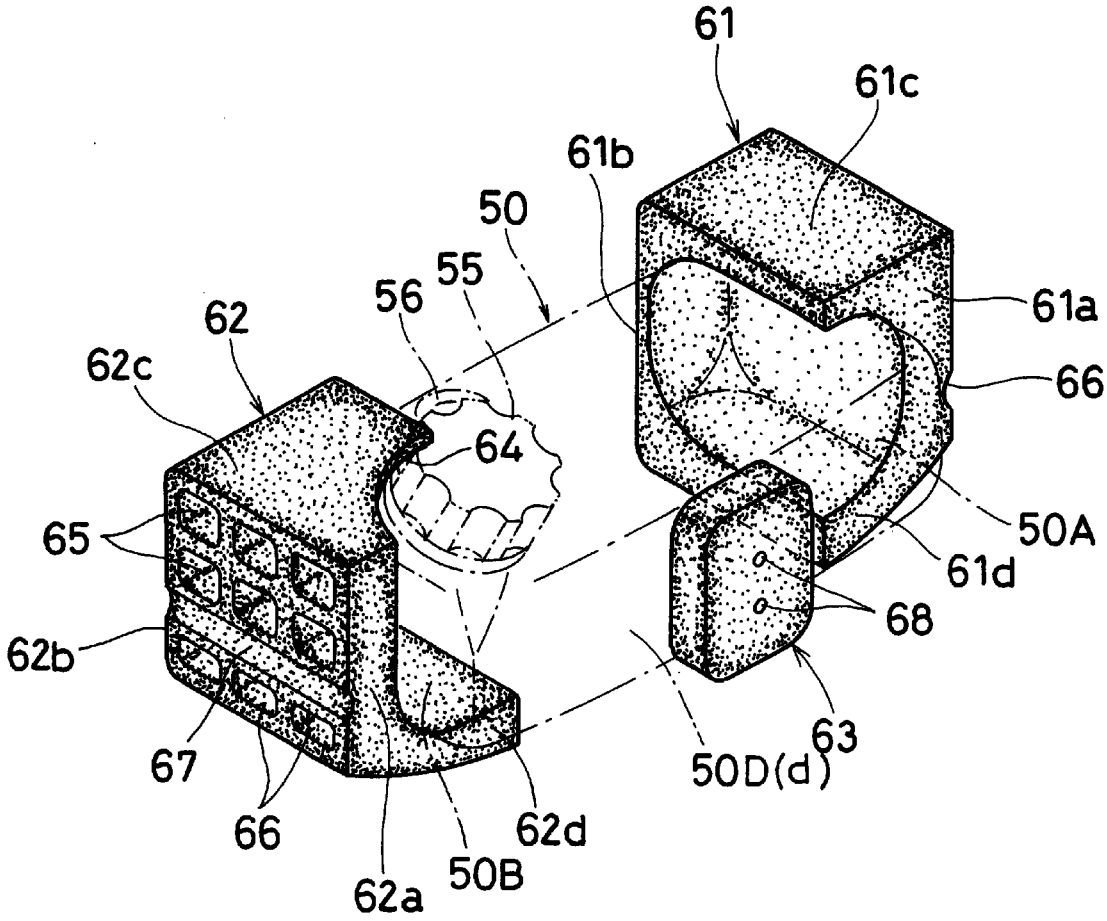
FIG. 3 is an enlarged perspective view illustrating the arrangement of cushioning members relative to a fuel tank in the leaf blower shown in FIG. 1.
Figure 4:
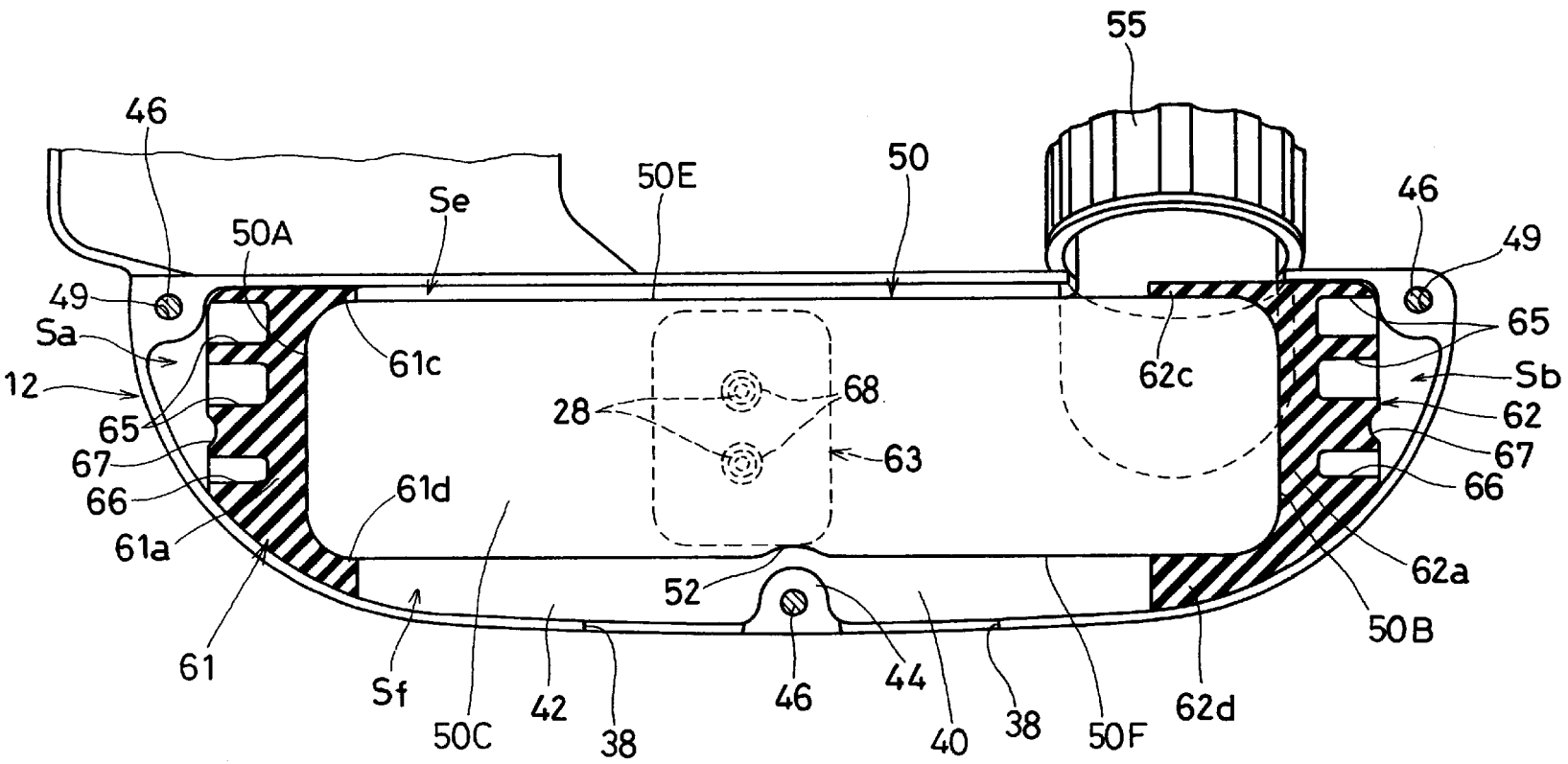
FIG. 4 is a cross sectional view taken along the line IV—IV in FIG. 1.
Figure 5:
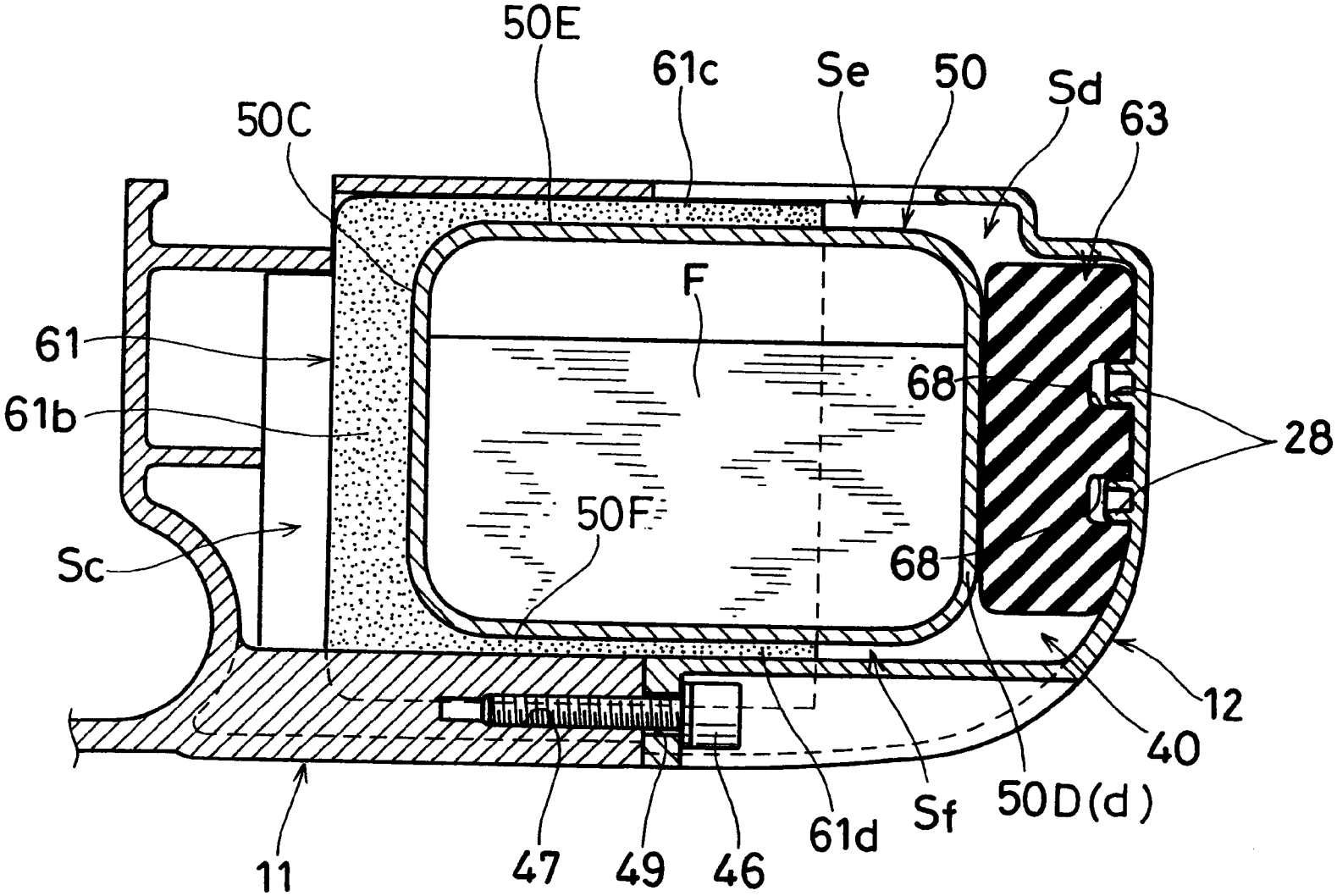
FIG. 5 is a cross sectional view taken along the line V—V in FIG. 1.

As best shown in FIGS. 3 and 4, the front-end sustaining cushioning member 61 is generally U-shaped in cross section as it is viewed in two orthogonal directions (from the side and from the rear) and comprises a front end wall 61*a*, a left side wall 61*b*, a top wall 61*c* and a bottom wall 61*d*, which are designed to contact four faces (excluding the right side face 50*d*) among the five faces constituting the front end portion 50A of the fuel tank 50, so that the front-end sustaining cushioning member 61 is adapted to be mounted so as to hold the front end portion 50A of the fuel tank 50. The rear-end sustaining cushioning member 62 is also generally U-shaped in cross section as it is viewed in two orthogonal directions (from the side and from the front) and comprises a rear end wall 62*a*, a left side wall 62*b*, a top wall 62*c* and a bottom wall 62*d* which are designed to be contacted with four faces (excluding the right side face 50*d*) among the five faces constituting the rear end portion 50B of the fuel tank 50, so that the rear-end sustaining cushioning member 62 is adapted to be mounted so as to hold the rear end portion 50B of the fuel tank 50.

The front end wall 61*a* of the front-end sustaining cushioning member 61 as well as the rear end wall 62*a* of the rear-end sustaining cushioning member 62 are made larger in thickness than the other walls, and are respectively provided on the outer wall thereof with rectangular recessed portions 65 which are arranged in two rows and three columns at an upper portion of the outer wall, with rectangular recessed portions 66 which are arranged in one row and three columns at a lower portion of the outer wall, and with an intermediate horizontal groove 67. Further, the rear-end sustaining cushioning member 62 is provided at the top wall 62*c* thereof with an arch-shaped cut-out portion 64 in order to prevent the top wall 62*c* from interfering with the fuel-filling port 55.

A side wall-contacting cushioning member 63 is formed of a rectangular plate and is designed to be contacted with a central portion of the right side wall 50*d* of the fuel tank 50. Further, as clearly seen from FIG. 5, the side wall-contacting cushioning member 63 is provided at central upper and lower portions thereof with a pair of circular holes 68, respectively, for enabling a pair of protrusions 28 of the right tank housing portion 42 (the right cover housing 12) to be fitted therein (see FIG. 5) so as to hold the cushioning member 63 in place.

In the case of the fuel tank-mounting structure of the leaf blower 1 according to the embodiment which is constructed as described above, as shown in FIGS. 4 and 5, the fuel tank 50 is designed to be retained in the tank housing portion 40 (41, 42) by being embraced not only by a pair of end portion-sustaining cushioning members 61 and 62, each having a generally U-shaped cross section, the inner surface of which is designed to be contacted with four faces among five faces constituting each of the front and rear end portions 50A and 50B.

In other words, the cushioning members 61, 62 (i.e., wall portions 61*a*, 62*a*, 61*c*, 62*c*, 61*d* and 62*d*) and 63 are interposed in the spaces Sa, Sb, Sc, Sd, Se and Sf formed between the tank housing portion 40 and all faces of the fuel tank 50, i.e. the front and rear side faces, the right and left side faces, and the top and bottom faces of the fuel tank 50. In this case, the cushioning members 61, 62 and 63 are immovably sandwiched between the cover housings 11 and 12 defining the tank housing portion 40 and the fuel tank 50. Therefore, the fuel tank 50 is sustained in the tank housing portion 40 in such a manner that the fuel tank 50 is "floated" away from the inner surfaces (all inner surfaces) of the tank housing portion 40 by means of the cushioning members 61, 62 and 63.

With the fuel tank-mounting structure constructed as described above, the vibration of the internal combustion engine 30 or of the air blower 20 is attenuated by the cushioning members 61, 62 and 63 and hence the vibration can be hardly transmitted to the fuel tank 50, thereby making it possible to inhibit the generation of bubbles of the fuel as well as the deterioration in performance of the engine. Furthermore, since the mounting members (such as the aforementioned anchoring lugs of FIG. 6) and screws for fastening the fuel tank are no longer required to be employed, the configuration of the fuel tank can be selected relatively freely, and at the same time, the manufacturing cost of the power machine can be reduced. Additionally, since the fuel tank is embraced by the cushioning members, the fuel tank is well protected from damage.

The cushioning members 61, 62 and 63 should preferably be manufactured somewhat larger in size than the tank housing portion so as to permit the cushioning members 61, 62 and 63 to be slightly compressed between the fuel tank 50 and the cover housings 11 and 12 when the cushioning members 61, 62 and 63 are installed, together with the fuel tank 50 in the tank housing portion 40. Further, if the fuel tank 50 is made of a synthetic resin having a suitable degree of an oil-swelling property, such as polyethylene, the fuel tank 50 can be suitably swelled with time, thereby making it possible to maintain the tightness in retention of the fuel tank 50, even if the cushioning members 61, 62 and 63 lose some of the initial compression. Therefore, even if fuel is spilled out when the tank is being filled, the spilled fuel can be prevented from entering into the interface between the fuel tank 50 and cushioning members 61, 62 and 63, and can be simply allowed to fall and discharge through the openings 38 formed at the bottom of the cover housings 11 and 12.

If engine cooling air is inducted from the openings 38 formed at the bottom of the tank housing portion 40 and flows along portions of the sides of the fuel tank 50, the fuel tank 50 can be cooled by the cooling air.

Although a preferred embodiment of the present invention has been explained in the foregoing description, it should be understood that the present invention is not limited to these embodiments, but can be varied without departing from the spirit and scope of the invention set forth in the accompanying claims.

As seen from the above explanation, it is possible, with the fuel tank-mounting structure of the present invention, to prevent the vibration of the internal combustion engine from being easily transmitted to the fuel tank, thereby avoiding the deterioration in performance of the engine due to the forming of bubbles in the fuel, preventing damage or breakage of the fuel tank, and reducing the manufacturing cost thereof.

What is claimed is:

1. A fuel tank-mounting structure for a portable power working machine having an internal combustion engine as a power source and a fuel tank, the fuel tank being received in a tank housing portion defined in a two-piece cover housing of the power working machine, comprising at least one cushioning member supporting the fuel tank in the tank housing portion of the two-piece cover housing, wherein the at least one cushioning member is interposed in spaces between the tank housing portion and all faces of the fuel tank, namely, the front and rear end faces, the right and left side faces, and the top and bottom faces of the fuel tank.

2. The fuel tank-mounting structure according to claim 1, wherein the at least one cushioning member is immovably sandwiched between the cover housing and the fuel tank.

3. The fuel tank-mounting structure according to claim 1 or 2, wherein said structure comprises a front end portion-sustaining cushioning member of a generally U-shaped in cross section and having an inner surface that engages at least three faces of the fuel tank selected from the group consisting of the front end face, the right side face, the left side face, the top face and the bottom face of the fuel tank and a rear portion-sustaining cushioning member of a generally U-shaped in cross section and having an inner surface that engages at least three faces of the fuel tank selected from the group consisting of the rear end face, the right side face, the left side face, the top face and the bottom face of the fuel tank.

4. The fuel tank-mounting structure according to claim 1 or 2, wherein said structure comprises a front end portion-sustaining cushioning member having a generally U-shaped cross section, the inner surface of which contacts four faces of the fuel tank including the front end face, the top face, the bottom face and one of the right side face and the left side face of the fuel tank, a rear end portion-sustaining cushion member having a generally U-shaped cross section, the inner surface of which contacts four faces of the fuel tank including the rear end face, the top face, the bottom face and said one of the right side face and the left side face of the fuel tank, and a side face-sustaining cushioning member which contacts the other of the right side face and the left side face.

* * * * *